United States Patent [19]

Taylor

[11] Patent Number: 4,535,795

[45] Date of Patent: Aug. 20, 1985

[54] NON-ELECTRIC PORTABLE DISHWASHER

[76] Inventor: Frank J. P. Taylor, 25301 Cabot Rd., Laguna Hills, Calif. 92653

[21] Appl. No.: 602,836

[22] Filed: Apr. 23, 1984

Related U.S. Application Data

[63] Continuation-in-part of Ser. No. 441,384, Nov. 12, 1982, Pat. No. 4,444,213, which is a continuation-in-part of Ser. No. 205,710, Nov. 13, 1980, Pat. No. 4,368,747.

[51] Int. Cl.[3] ..... B08B 3/02

[52] U.S. Cl. ..... 134/93; 134/95; 134/99; 134/138; 134/153; 134/155

[58] Field of Search ..... 134/56 D, 93–95, 134/100, 101, 138, 139, 141, 99, 153–155, 186, 190, 200

[56] References Cited

U.S. PATENT DOCUMENTS

| | | | |
|---|---|---|---|
| 1,897,821 | 2/1933 | Poli | 134/93 |
| 1,907,269 | 5/1933 | Selmer | 134/139 |
| 1,915,162 | 6/1933 | Klaiber | 134/141 |
| 2,562,076 | 7/1951 | Weisselberg | 134/139 |
| 2,567,820 | 9/1951 | Messerschmidt | 134/138 |
| 3,203,436 | 8/1965 | Wallgren et al. | 134/93 X |
| 3,469,586 | 9/1969 | Berson et al. | 134/93 |

FOREIGN PATENT DOCUMENTS

| | | | |
|---|---|---|---|
| 15250 | 1/1956 | Fed. Rep. of Germany | 134/153 |
| 1503825 | 10/1969 | Fed. Rep. of Germany | 134/56 D |
| 2647356 | 5/1977 | Fed. Rep. of Germany | 134/138 |

*Primary Examiner*—Philip R. Coe

*Attorney, Agent, or Firm*—James E. Brunton

[57] ABSTRACT

An improved rotatable dishwasher designed for use in areas having low domestic water pressure which is adapted to be connected to both the domestic hot and cold water supply lines. The dishwasher includes a housing, a rack rotatably mounted within the housing, the rack being adapted to support articles to be washed, a water jet subassembly including a control mechanism for directing jets of water in the direction of the rack to impart rotational movement thereto, the jet subassembly comprising a first collimated jet for emitting a collimated stream of cold water in the direction of the rack for initiating rotation thereof and second and third spray jets adapted to cooperate to sustain rotation of the rack. The second spray jet emits cold water in the direction of the rack while the third spray jet emits hot water in the direction of the rack via a dosing unit which meters an emulsifier into the stream of hot water to assist in the cleaning action.

8 Claims, 5 Drawing Figures

NON-ELECTRIC PORTABLE DISHWASHER

This application is a continuation-in-part application of my co-pending application Ser. No. 441,384, filed Nov. 12, 1982, and now U.S. Pat. No. 4,444,213, which was in-turn a continuation-in-part application of my application Ser. No. 205,710, filed Nov. 13, 1980, and now U.S. Pat. No. 4,368,747.

BACKGROUND OF THE INVENTION

1. Field of the Invention

The present invention relates generally to dishwashers and more particularly to a non-electric, self-contained, portable dishwasher unit adapted to be removably interconnected with a domestic water supply.

2. Discussion of the Prior Art

Portable dishwashers operable solely by water pressure are not new. Several such units have been manufactured and sold in recent years. A common drawback of such units, however, has been their inability to rapidly and effectively clean dishes and cookware.

Many of the prior art units are cheaply constructed and have been sold more as a novelty item than as a bona fide, high performance dishwashing device. Generally, the washing action in such units is attempted by one or more rapidly rotating emitters located beneath or along side a rack holding the dishes. These emitters, which operate in much the same manner as lawn sprinklers, have proven ineffective in the removal of most troublesome types of food residue on the dishes. Other types of emitters have from time to time been tried, but for the most part have also proven to be ineffective.

One of the most effective dishwasher units ever developed is the unit discussed in my co-pending application Ser. No. 441,384, and now U.S. Pat. No. 4,444,213. This unit, for the first time, overcomes the quality and performance drawbacks inherent in its predecessor prior art devices. Like the apparatus of my earlier designs, as shown in Ser. No. 441,384, and now U.S. Pat. No. 4,444,213, and in U.S. Pat. No. 4,368,747, the present invention is not a toy, or a novelty item, but rather is a carefully engineered, high performance device adapted to rapidly and efficiently remove even the most difficult food residue from dishes and cookware.

The improved device of the present application is specially designed for use in geographic areas where the domestic hot water sources are at relatively low pressure while the domestic cold water sources are at a higher pressure. The novel water jet means of this new improved unit controllably directs a multiplicity of hot and cold water jets from two cooperating, apertured conduits at the articles to be washed while they are supported within the unit on a unique holding rack which is precisely rotated at an optimum rate of speed. These cooperating hot and cold water jets may be directed to impinge upon all the surfaces of the dishes supported within the rotating rack and create a unique scrubbing type of action which loosens and dislodges even the most difficult of residues. A dosing chamber precisely mixes an emulsifier, such as liquid soap, with the hot water upstream of the water jets thereby enhancing the cleaning efficiency of the device.

An important aspect of the present invention is the improved water jet means and the control means associated therewith. The water jet means comprises a first collimated jet means adapted to initiate rotation of the rotatable rack which supports the dirty dishes, and an adjustable second spray jet means which accomplishes the efficient scrubbing and cleansing action and sustains the rotation of the rack. The control means which are associated with the jet means permit a smooth transition between the activation of the first collimated jet means the spray jet means to obtain efficient initiation of rotation followed by maximum cleaning effectiveness. The spray jet means comprises a pair of juxtapositioned conduits formed of hollow tubing which are uniquely apertured so that a multiplicity of fine, very high velocity hot and cold water jets bombard the dishes from all angles, from above, from below and from the sides. The unique hole pattern formed in the conduits permits optimum controlled rotation of the supporting rack while at the same time accomplishing maximum cleaning and scrubbing of the dishes. As will be discussed in greater detail hereinafter, one of the conduits carries high pressure cold water, while the other carries lower pressure hot water.

Another aspect of the present invention reside in the novel apparatus embodied in the dishwater unit for preventing back flow of fluid from the dishwasher unit into the domestic water supply.

SUMMARY OF THE INVENTION

It is an object of the present invention to provide an improved non-electric, free standing, self-contained rotatable dishwasher for washing dishes, cookware and the like which is operable by water pressure and is adapted to be connected to both the hot water and cold water lines of the character leading to kitchens and bathrooms of houses and apartments.

It is another object of the invention to provide a dishwasher of the aforementioned character in which, in operation, a multiplicity of very fine high velocity jets of both hot and cold water are directed at the articles to be washed from a multiplicity of directions, said jets being of such force as to quickly and efficiently dislodge and thoroughly clean even the most stubborn of food residues and greases.

It is another object of the invention to provide a dishwasher of the character described in which means are provided for uniformly and controllably mixing a soap or detergent with the hot water jets. This novel means is adapted to precisely meter the emulsifier into the hot water stream so as to economically use only the minimum amount of emulsifier necessary to effectively clean the dishes.

Still another object of the invention is to provide a dishwasher of the type described in the preceding paragraphs in which the articles to be washed are strategically held in position upon a uniquely configured rotating rack adapted to orient the articles with respect to a pair of cooperating spray jet conduits, one carrying hot water and the other cold water, which conduits are uniquely apertured to produce high velocity water jets adapted to accomplish a novel scrubbing type of action to enable maximum cleaning in a minimum time.

Another object of the invention is to provide a dishwasher as described in the previous paragraph in which, during the start-up mode, a first collimated water jet is directed at the rotatable rack to initiate rotation. Once the starting inertia of the rack is overcome, the first water jet can be fully or partially closed, and the force of both the hot and cold water is directed toward a dual conduit jet spray system which sustains the rotation of the rack and at the same time effectively accomplishes the washing operation. The novel control mechanism of the invention permits a smooth transition between the starting and scrubbing mode and is easily operated from the exterior of the unit.

A further object of the invention is to provide an improved dishwasher of the class described which is compact, light weight, easily portable, highly attractive and extremely simple to use and maintain.

Another object of the invention is to provide a dishwasher of the aforementioned character which can be readily interconnected to domestic water supply lines and which includes drain means for conveniently draining the unit into an existing kitchen or bathroom sink.

These and other objects of the invention are realized by an improved rotatable dishwasher adapted to be connected to hot and cold domestic water supply lines, comprising a housing, a rack rotatably mounted within the housing, the rack being adapted to support articles to be washed, jet means for directing a jet of water in the direction of said rack to impart rotational movement thereto, the jet means comprising a first collimated jet for emitting a collimated stream of cold water in the direction of the rack for initiating rotation thereof and a second, dual tube hot and cold water spray jet system for sustaining rotation of said rack.

DESCRIPTION OF ONE FORM OF THE INVENTION

Figure 1:
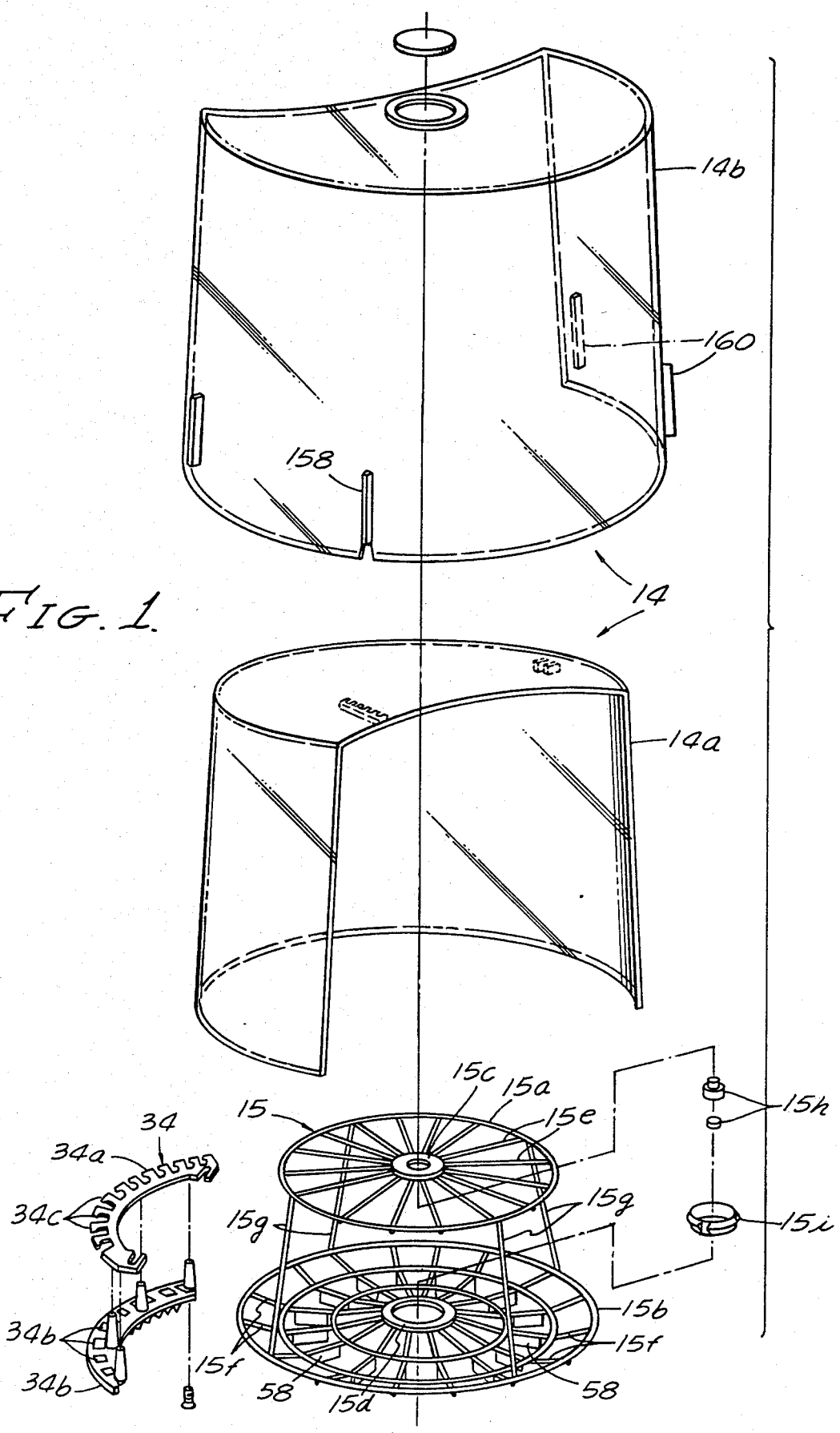
FIG. 1 is an exploded generally perspective view of the outer housing and article supporting racks of the apparatus of the invention.
Figure 2:
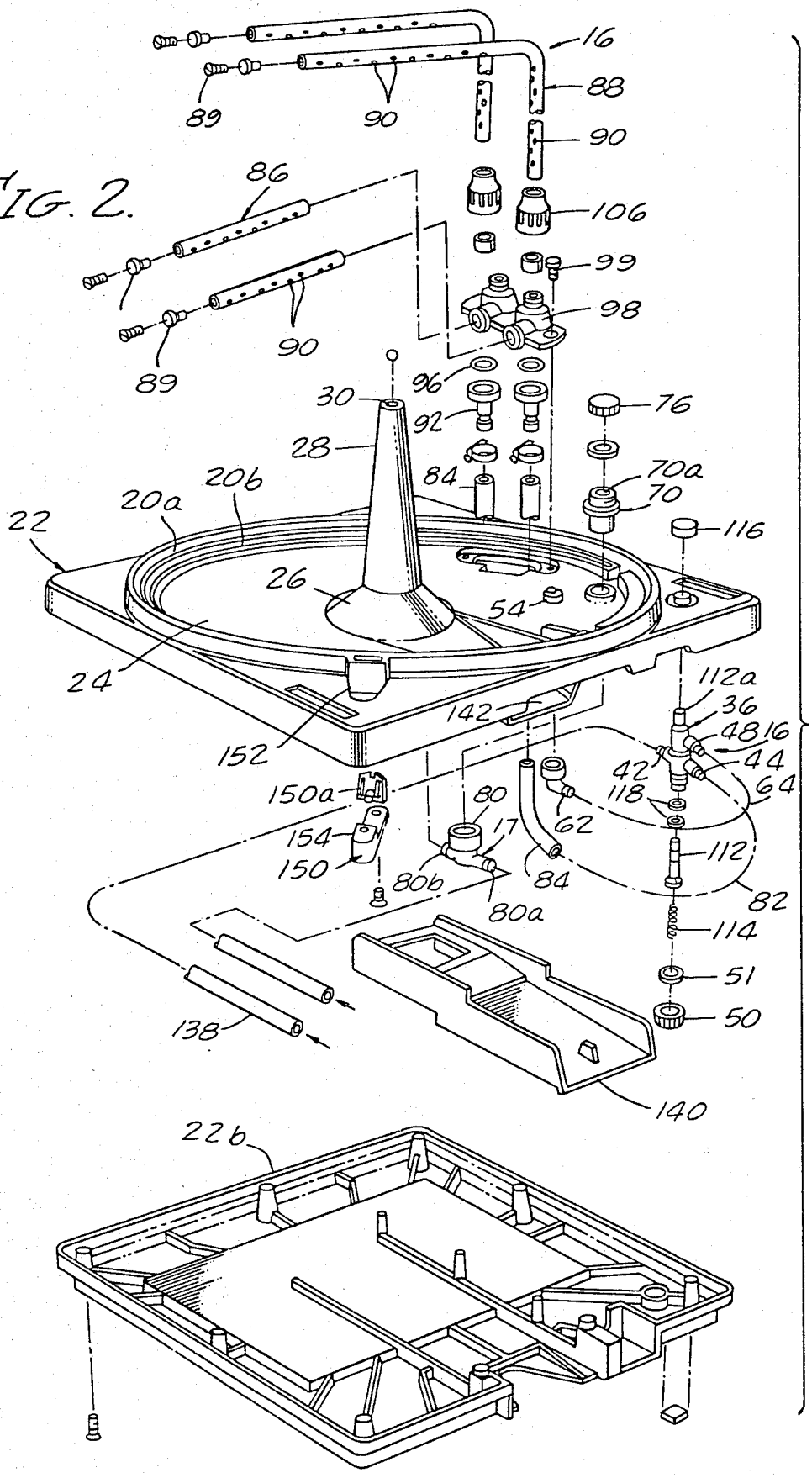
FIG. 2 is an exploded generally perspective view of the base, jet means and control means of the apparatus as they appear with the supporting rack and outer housings removed.

Referring now to the drawings and particularly to FIGS. 1 and 2, the dishwasher of the present invention includes a housing 14, a rack assemblage 15 mounted for rotation within housing 14, jet means 16 (FIG. 2) for directing a jet of cold water at rack assemblage 15 to impart rotational movement thereto and dosing means 17 for dosing with an emulsifier the hot water flowing from the hot water inlet.

As shown in FIG. 1, the housing 14 of the unit, which can suitably be constructed of thin plastic or sheet metal, comprises a first stationary part 14*a* and a rotatable part 14*b* which comprises the closure means of the apparatus. While the housing shown in the drawings is generally cylindrical in shape, it could be constructed in other configurations to meet particular design requirements.

Referring particularly to FIG. 2, the housing 14 is received in concentric, circular tracks 20*a* and 20*b* formed in the upper portion 22*a* of a generally rectangular base 22. The fixed portion 14*a* of the housing is sealably received in track 20*b* while the movable portion 14*b* of the housing is received for sliding movement within track 20*a*.

Track 20*b* defines the outer periphery of a floor 24 which slopes radially inwardly toward a frustoconically shaped, upwardly extending hub 26. Extending upwardly from hub 26 is a frustoconically shaped column 28 having at its upper end a recess 30 adapted to closely receive a ball bearing 32 adapted to rotatably support rack 15 for rotation about column 28. The upper portion 22*a* of the base is affixed to a lower portion 22*b* to form an internal cavity, the purpose of which will be presently discussed.

Turning once again to FIG. 1, rack assemblage 15 includes a rack having upper and lower circularly shaped members 15*a* and 15*b* and apertured hub portion 15*c* and 15*d*. Radiating outwardly from these hub portions are a plurality of spokes 15*e* and 15*f*. The upper and lower members 15*a* and 15*b* are maintained in a vertically spaced apart location by four supports 15*g*. Receivable with the apertures of hub portions 15*c* and 15*d* are inserts 15*h* and 15*i*. The rack is preferably constructed of coated steel wire and is specially configured to carry and strategically position various items of crockery, cutlery, dishes and cookware with the housing and in a specific relationship with respect to the spray jet means.

When assembled for operation, rack assemblage 15 is rotatably supported by column 28 with insert 15*i* being disposed in close proximity with the lower portion of the column and with insert 15*h* resting upon and being rotatably supported by the ball bearing 32. With this arrangement the rack assemblage is freely rotatable with housing 14 about the central column 28.

Also forming a part of the rack assemblage 15 is a uniquely configured silverware holder 34 comprising upper and lower members 34*a* and 34*b*. These members, which are held in a vertically spaced apart position by means of adjacent pairs of the supports 15*g*, are provided with silverware support means for positioning the silverware to be washed at a slight angle with respect to the vertical axis of the unit. More specifically, the upper member 34*a* is provided with a plurality of circumferentially spaced apart hook-like protrusions 34*c* which define openings therebetween adapted to receive the handle portion of the silverware. Similarly lower member 34*b* is provided with a plurality of circumferentially spaced apart apetures 34*d*, or recesses, adapted to support the opposite end of the silverware. Apertures 34*c* and 34*d* are angularly offset so that the silverware will be maintained on an angular, or sloping, orientation during the washing operation which has been found to be optimum for an efficient scrubbing action by the water spray jets.

In the embodiment of the invention shown in the drawings, the jet means 16 comprises a first collimated jet means for directing a collimated stream of water at the rack assemblage for initiating rotation thereof and a second and third spray jet means for sustaining rotation of the rack assemblage once the starting inertia of the rack has been overcome by the first jet means. To control the rotation of the rack, control means is provided. This control means is cooperatively associated with the second spray jet means and the collimated jet means to normally direct the flow of cold water through the latter during the start-up operation and then through the former during the normal wash cycle.

Figure 3:
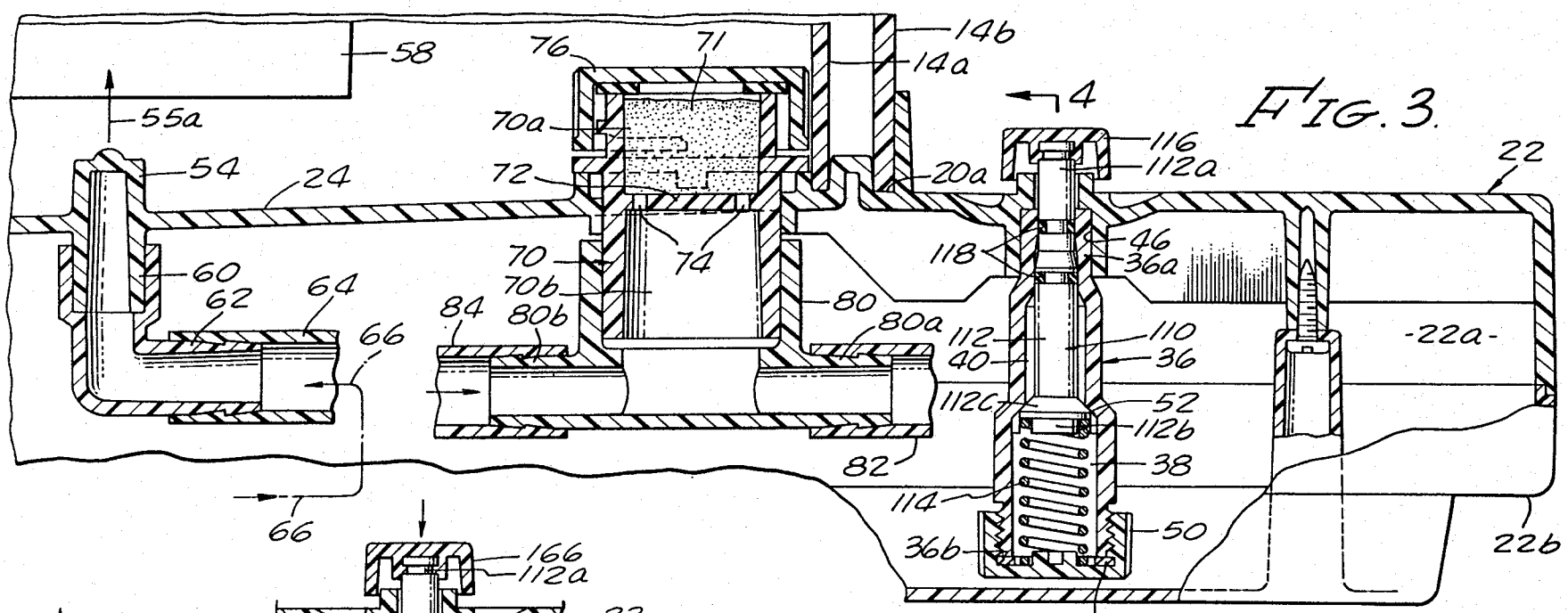
FIG. 3 is a fragmentary cross-sectional view of portions of the jet and control means of the invention showing the configuration of the first collimated jet means, the dosing means and the control means for controlling the direction of flow of the water received from the domestic water lines.
Figure 5:
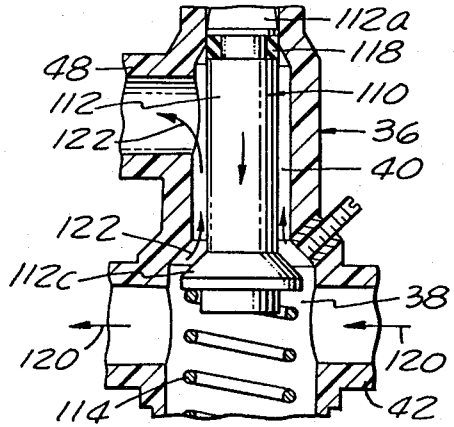
FIG. 5 is an enlarged fragmentary cross-sectional view of a portion of the control means showing it in a position which permits the flow of water toward the first collimated jet.
Figure 4:
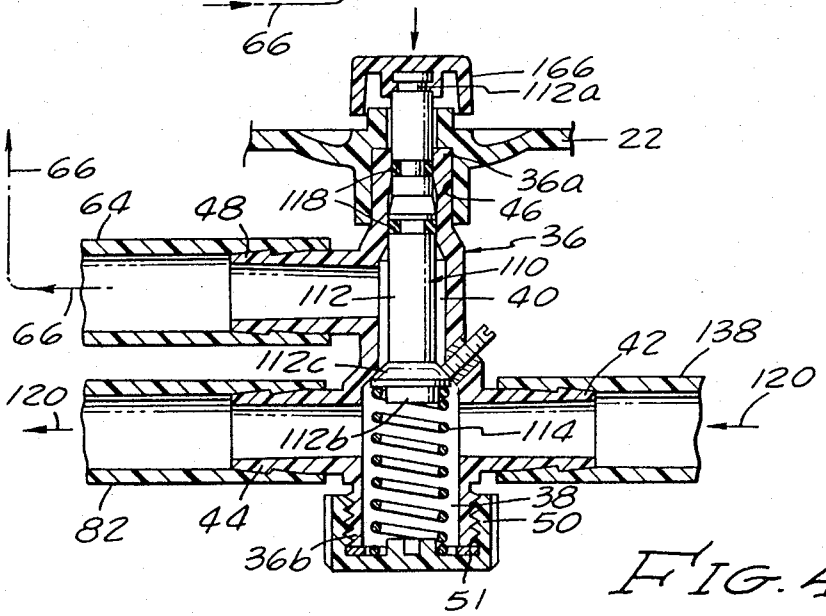
FIG. 4 is a fragmentary cross-sectional view taken along lines 4—4 of FIG. 3 showing the internal construction of the control means.

Turning to FIGS. 2, 3, 4 and 5, the jet means 16 of the invention can be seen to comprise a cylindrically shaped housing 36 defining first and second chambers 38 and 40 (FIGS. 3 and 4). Housing 36 has a cold water, or high pressure, inlet connection 42 leading into chamber 38 and a first outlet connection 44 leading from chamber 38. The housing is received proximate its upper end 36*a* within a counter bore 46 formed in base 22 (FIG. 4). Additionally, housing 36 has a second outlet connection 48 in communication with chamber 40. The lower end 36*b* of housing 36 is closed by a threaded cap 50 and washer 51. Formed between chambers 38 and 40 is a valve seat 52, the purpose of which will presently be described.

In the present form of the invention, the previously described first collimated jet means comprises an upwardly extending hollow housing 54 formed as an integral part of floor 24 of base 22 (See FIG. 2 for the relative location of housing 54 with respect to column 28). Housing 54 is provided with a small aperture 55 proximate its upper end for directing a high pressure, collimated stream of water in the direction indicated by arrow 55*a* in FIG. 3 toward one of a plurality of vanes 58 which depend from the lower member 15*b* of the rack assemblage.

Referring once again to FIGS. 3 and 4, the first collimated jet means also comprises a downwardly extending portion 60 which is integrally formed with floor 24 and which is interconnected with an inlet connection 62. This inlet connection 62 is connected by means of a fluid conduit 64 with outlet connection 48 of housing 36 so that fluid can flow in the direction of the arrows 66 in FIGS. 3 and 4.

Also forming a part of the apparatus of the present invention is the previously mentioned dosing means 17 which is adapted to cooperate with the jet means for dosing water flowing through the jet means with an emulsifier. In the present form of the invention, the dosing means comprises a housing 70, having an upper chamber 70*a* (FIG. 3) disposed above floor 24 and a lower chamber 70*b* disposed below floor 24. Chambers 70*a* and 70*b* are divided by a partition 72 and are in communication with one another via two holes 74 extending through the partition 72. Chamber 70*a* is closed by a cap 76 which is removably interconnected to housing 70 by any suitable means such as a bayonet-type connection means. With the cap removed a liquid or powdered soap 71 can be added to chamber 70*a*. Connected to the lower end of housing 70 is a coupler member 80 which has an inlet connection 80*a* and an outlet connection 80*b*. Inlet connection 80*a* is connected to a source of domestic hot water by a fluid conduit 82 (FIG. 2). By means of fluid conduit 84, outlet connection 80*b* is, in turn, connected to the inlet of the third spray jet means, the construction of which will now be discussed.

As best seen be referring to FIG. 2, in the present embodiment of the invention, the second and third spray jet means are provided in the form of a pair of side by side, specially configured hollow tubes or conduits comprising first substantially horizontal extending conduit leg portions 86 and 87 extending beneath rack assemblage 15, substantially vertically extending conduit leg portions 88 and 89 adapted to be disposed proximate the periphery of rack 15. Integrally formed with leg portions 88 and 89 are substantially horizontally extending portions 88*a* and 89*a* disposed above rack 15. The inboard ends of portions 86, 87 88*a* and 89*a* are closed by plug assemblages "P".

The tubing of the second and third spray jet means may be constructed from copper, aluminum, plastic or other suitable durable material which can be bent into the configuration shown in FIG. 2. In FIG. 2 it can be seen that a multiplicity of small holes 90 are drilled in a specific pattern in each of the leg portions as well as in the vertically extending portion of the tubing. The pattern of holes 90 is carefully engineered to create a three dimensional water spray pattern within housing 14 which sustains rotation of rack 15 and produces a unique scrubbing type of cleansing action on the dishes and cookware supported in rack assemblage 15. The position of these holes or apertures 90 is such that through each aperture there is directed a high velocity spray jet which impinges on the articles to be washed. The velocity of these jets coupled with the three dimensional pattern thereof creates a highly novel and unique scrubbing action upon the articles supported within rack assemblage 15.

As previously discussed, an important aspect of the present invention is the provision of the second and third spray jet means which are in communication with the hot and cold domestic water supply. More particularly the second spray means communicates with the cold water supply while the third spray jet means communicates with the lower pressure, hot water supply via the dosing means through conduit 84 (FIG. 2) which in turn is connected at one of its ends to connector 80*b*. The second spray jet means communicates with the higher pressure cold water supply via connector 85, one end of which is connected to outlet connection 44 of housing 36. The other end of conduit 85 is connected to a connector 92 (FIG. 2) which forms a part of the second spray jet means of the present embodiment of the invention. Connector 92 has a shank portion 92*a* and a flange portion 92*b*. Shank 92*a* extends through floor 24 and flange 92*b* is provided with a groove adapted to receive a resilient O-ring 96 which is disposed in sealing engagement with the lower surface of one side 98*a* a "T" 98 which is affixed to floor 24 by threaded connectors 99 and which also forms a part of the second jet spray means.

Adapter 98 has a inlet passageway 100 in communication with connector 92, a first outlet 102 adapted to receive the inner end of leg portion 87 and a second outlet 104 adapted to rotatably receive the lower end of leg portion 88 of the spray tube. Outlet 104 is externally threaded to accommodate a closure member 106 having a throat portion 106*a* within which the lower end of the leg portion 88 of the spray tube is closely received. With this arrangement the spray tube can be rotated angularly with respect to the rack assemblage about its vertically extending axis by simply loosening closure member 106.

Considering again the third spray jet means of the invention, the end of conduit 84 opposite from that connected to the dosing means 17 is connected to a connector 93 which forms a part of the third spray jet means of the present embodiment of the invention. Connector 93 has a shank portion 93*a* and a flange portion 93*b*. Shank 93*a* extends through floor 24 and flange 93*b* is provided with a groove adapted to receive a resilient O-ring 95 which is disposed in sealing engagement with the lower surface of one side 98*b* a "T" adapter 98 which is affixed to floor 24 by threaded connectors 99.

Adapter 98 has an inlet passageway 101 in communication with connector 93, a first outlet 103 adapted to receive the inner end of leg portion 86 and a second outlet 105 adapted to rotatably receive the lower end of leg portion 89 of the spray tube. Outlet 105 is externally threaded to accommodate a closure member 107 having a throat portion 107*a* within which the lower end of the leg portion 89 of the spray tube is closely received. With this arrangement the spray tube can be rotated angularly with respect to the rack assemblage about its vertically extending axis by simply loosening closure member 107.

In the present embodiment of the invention closure member 106 and 107 and adaptor 98 comprise the primary components of the adjustment means for adjusting the orientation of the second and third spray jet means. While the components are shown as threadably interconnected, other connections such as press fit or bayonet-type connections can be used. By adjusting the spray tube in the manner described, the angle at which jets of water emanating from the dual spray tubes strike the dishes emplaced upon the rack assemblage can be precisely adjusted. This enables precise control over the speed of rotation of the rack assemblage during the washing cycle and insures an optimum scrubbing action by the jets of water striking the dishes at the most effective angle. Since the pressure of both the hot and cold water supplies are utilized, the scrubbing action is highly effective even in areas where the domestic hot water pressure is low.

When the spray jet means are in an operating position the inboard ends of leg portions 86 and 87 are supported by frustoconical portion 26*a* and in this way they are at all times maintained in a spaced relationship with the sloping floor 24 and out of contact with the dishwasher as it drains toward the center of the unit. This is an important safety aspect of the apparatus which tends to insure against back flow of the dirty dishwater into the domestic water supply in the event of a drop in source water pressure.

Another extremely important aspect of the present invention resides in the unique and improved control means for controlling the flow of water between the first collimated jet means and the second jet spray means. Turning once again to FIGS. 3, 4 and 5, this control means comprises a valve assemblage carried within housing 36 and generally designated in the drawings by the numeral 110. Assemblage 110 includes a valve stem 112 having upper and lower extremities 112*a* and 112*b*. Intermediate its extremities valve stem 112 is provided with a tapered surface 112*c* adapted to sealably engage the previously identified valve seat 52 when the valve is in a closed position. To continuously urge the valve stem upwardly and into a closed position is a biasing means provided in the form of a coil spring 114 disposed within housing 36 intermediate cap 50 and the bottom of the valve steam 112.

The upper end 112*a* of the valve stem normally extends above the upper surface of base 22 when the valve is in a closed position. A cap, or push button 116 is carried by upper end 112*a* of the valve stem. Intermediate portions of the valve stem 112 are maintained in sealable engagement with the inner walls of housing 36 by O-rings 118.

When the valve assemblage is closed, as shown in FIG. 4, water from the domestic cold water supply flows, in the direction of the arrows 120, through connectors 42 and 44 and into conduit 85. However, when the valve is opened by depressing button 116 causing stem 112 to move downwardly so that portion 112*c* moves away from seat 52, water will be permitted to flow in the direction of the arrows 122 toward connector 48. With the valve thusly opened, water will flow through connector 48 into conduit 64 and toward the collimated jet means (see FIG. 3). The water flowing under pressure into housing 54 will create the high velocity collimated water jet indicated by the arrow 55*a*. This water jet sequentially strikes the vanes 58 (FIG. 1) at the bottom of the rack assemblage causing it and the dishes carried therein to rotate about column 28.

Once the start-up inertia of the rack assemblage is overcome, release of the button will, due to the urging of spring 114, cause the valve to move toward the closed position with all of the water once again being directed toward the second spray jet means.

Still another important feature of the presently described improvement is the override means which forms a part of the control means and which functions to permit a controlled, continuous flow of a portion of the cold water through the collimated jet means toward the vanes 58 to assist in maintaining optimum rotation of the rack assemblage. As best seen by referring to FIGS. 3 and 5, the override means in this form of the invention comprises a manually adjustable set screw assembly 119 carried by housing 36 proximate tapered surface 112*c* of valve stem 112. Assembly 119 comprises an internally threaded housing 121 adapted to threadably receive an externally threaded adjusting screw 123. The inner end of screw 123 is adapted to engage surface 112*c* while the outer end thereof is slotted to permit manual adjustment of the screw with a screwdriver or the like.

When the apparatus of the invention is to be used in geographic areas having low water pressure, the override means can be used to override spring 114 so that the valve stem cannot seat against the valve seat. In this way, a small portion of the cold water flowing through the control valve will continuously be diverted past the valve seat toward housing 54 of the collimated jet means. This flow of water will pass through aperture 55 to provide a continuous high pressure collimated stream of water in the direction of arrow 55*a* (FIG. 3) and toward one of a plurality of vanes 58 which depend from the lower member 15*b* of the rack assemblage. This collimated jet stream along with the water jets emanating from the second and third spray jet means will insure continuous controlled rotation fo the rack assemblage at an optimum rate of speed. Adjustment of screw 123 inwardly or outwardly relative to valve stem 112 will permit precise regulation of the amount of cold water flowing continuously toward the collimated jet means.

While in most cases the override means is set at the time the apparatus is first installed, adjustment may be periodically required if the pressure of the domestic water varies. It is to be understood that other means for more easily adjusting the position of valve stem 112 from the exterior of the unit can readily be devised by those skilled in the art without departing from the scope of the invention.

Other important features of the improved dishwasher of the present invention include the novel, retractable drain trough 140 (FIG. 2) which conveniently slides into and out of a guide 142 disposed within the cavity defined between the upper and lower base members 22*a* and 22*b* and the closure locking means which locks housing 146*b* in a closed position.

As best seen in FIG. 2, the guide 142 is integrally formed with floor 24 and is in communication with the washing chamber so that when trough 140 is in an extended position water will flow by force of gravity along the sloping floor 24 into the trough 140 for deposition into an adjacent sink or drain conduit. The drain trough 140 is of a capacity sufficient to adequately drain the apparatus with no fear of the water level therein rising above a safe, predetermined level.

Operation

In operating the apparatus of the embodiment of the invention shown in the drawings, the entire unit may be conveniently placed on a sink cabinet with the trough 140 being movable into an extended position overhanging the sink portion of the sink cabinet. In this position, water flowing from the interior of the unit along trough 140 will be safely deposited into the sink for drainage through the drain lines attached to the sink unit itself. With the assemblage in position on the sink cabinet, or drainage board, the apparatus may be interconnected with suitably valved hot and cold water supply lines generally designated in FIG. 2 by the numerals 151 and 153, respectively.

Once the dishwasher apparatus is interconnected with the water lines of the domestic supply and the drain trough is extended, the rotatable portion of the closure housing 14 rotated to an open position. In this open position free and convenient access to the rack assemblage 15 is provided. The dishes and silverware to be washed can then be placed on the rack assemblage and are strategically supported thereon by the structural elements of the assemblage so that continued rotation of the rack by the spray jet means will be assured after start-up inertia has been overcome by the collimated jet means.

Once the dishes and silverware have been loaded into the dishwasher apparatus, the rotatable portion of the closure housing can be moved into a closed position. When the rotatable portion of the closure housing is disposed in the closed position, the unit will be entirely water tight and the only water coming from the unit will be water draining through drain trough 140 into the sink.

With the closure housing in the closed position, the hot and cold water valves may be turned on, causing water to flow into the apparatus through conduits 82 and 155 (FIG. 2). By depressing member 116 of the control means, the water flowing through conduit 155 will be diverted so as to flow through conduit 64 toward the collimated jet means of the apparatus. This will cause a high pressure collimated jet of cold water to be emitted from the collimated jet means in a direction toward the vanes 58 which depend from the lower portion of the rack assembly (FIG. 3). This high pressure collimated stream of water will overcome the inertia of the rack assembly causing it to start to rotate. Once rotation has been achieved, push button 116 can be released and some or all of the cold water will be caused to flow through conduit 85 toward the second jet spray means of the apparatus.

Meanwhile, the hot water has been following into the third jet spray means via the dosing means or assemblage 17. As the water flows through the dosing means, the detergent contained therein will be metered into the stream of water and will flow along with the water into the third jet spray means.

Because of the unique arrangement and construction of the second and third spray jet means of the invention, the hot and cold water jets emitting from apertures 90 will impact the dishes carried on rack assemblage **15*a* in such a manner as to continue the constant rate of rotation of the rack assemblage. At the same time the unique design of the spray jet means will insure a highly efficient scrubbing action to efficiently and quickly remove food particles from the dishes carried on the rack assemblage. Should the operator desire to increase or decrease the speed of rotation of the rack assemblage, this may be accomplished by adjustment of the upper portions 88 and 89 of the spray jet means by simply loosening members 106 and 107, and then rotating the upper portions 88 and 89 of the jet spray means to change the angular orientation of the legs 88*a* and 89*a* with respect to the top of the rack assemblage. Once the desired orientation of legs 88*a* and 89*a* is achieved, members 106 and 107** can be retightened, thus locking the spray jet means in the selected optimum position.

In geographical areas of particularly low pressures the adjusting screw 123 of the override means can be moved into engagement with the valve stem 112 to override spring 114 and prevent complete sealing of the valve stem against the valve seat. In this way, a continuous flow of water can be maintained through the collimated jet means to assist the second and third spray jet means in maintaining an optimum rate of rotation of the rack assemblage.

After the dishes have been cleaned by the action of the spray jet means, the hot and cold water valving can be closed and the apparatus can be opened by simply rotating closure housing **14*b*** into an open position allowing easy access to the clean dishes residing on the rack assemblage.

Having now described the invention in detail in accordance with the requirements of the patent statutes, those skilled in this art will have no difficulty in making changes and modifications in the individual parts of their relative assembly in order to meet specific requirements or conditions. Such changes and modifications may be made without departing from the scope and spirit of the invention, as set forth in the following claims.

I claim:

1. A dishwasher, comprising:

(a) a base;

(b) a closure housing carried by said base;

(c) a rack rotatably mounted within said housing, said rack being adapted to support articles to be washed;

(d) jet means adapted for interconnection with sources of hot and cold water under pressure for directing jets of water in the direction of said rack to impart rotational movement thereto, said jet means comprising:

(1) a first collimated jet means for emitting a collimated stream of cold water in the direction of said rack for initiating rotation of said rack;

(2) a second spray jet means for emitting jets of cold water in the direction of said rack for sustaining rotation thereof;

(3) a third spray jet means for emitting jets of hot water in the direction of said rack for cooperating with said second spray means to sustain rotation of said rack; each of said second and third spray jet means comprising at least one apertured conduit disposed within said closure housing proximate said rack; and (4) control means for controllably and simultaneously regulating the flow of water between said first collimated jet means and said second spray jet means whereby a stream of cold water can be directed at said rack with sufficient velocity to initiate rotation thereof.

2. A dishwasher as defined in claim 1 in which said rack includes a lower portion and in which said control means comprises valve means for regulating the flow of water between said first collimated jet means and said second spray jet means in such a manner that a continuous stream of cold water can be directed from said collimated jet means toward said lower portion of said rack during rotation thereof.

3. A dishwasher as defined in claim 2 in which said valve means includes a valve housing carried by said base externally of said closure housing, said valve housing having:

(a) a water inlet adapted to be connected to said source of cold water;

(b) a first water outlet connected to said second spray jet means;

(c) a second water outlet connected to said collimated jet means;

(d) an internal valve seat disposed between said water inlet and said second water outlet;

(e) a valve stem movable from a first position wherein said valve seat is closed to fluid flow to a second position wherein said valve seat is open to fluid flow;

(f) biasing means for yieldably urging against movement of said valve stem from a first to a second position; and (g) means for preventing said valve stem from moving to said second position.

4. A dishwasher as defined in claim 3 in which said means for preventing said valve stem from moving to said second position comprises means carried by said housing for adjustably positioning said valve stem relative to said internal valve seat.

5. A dishwasher as defined in claim 4 including dosing means disposed intermediate said source of hot water and said third spray jet means for metering an emulsifier into said stream of hot water flowing through said third spray jet means.

6. A dishwasher adapted to be interconnected with a source of domestic hot water and a source of domestic cold water comprising:

(a) a base;

(b) a closure housing carried by said base;

(c) a rack rotatably mounted with said housing, said rack being adapted to support articles to be washed;

(d) jet means for directing a jet of cold water in the direction of said rack to impart rotational movement thereto, said jet means comprising:

(1) a first collimated jet means for emitting a collimated stream of cold water in the direction of said rack for initiating rotation of said rack; and (2) a second spray jet means for emitting jets of cold water in the direction of said rack and a third spray jet means for emitting jets of hot water in the direction of said rack, said second and third spray jet means cooperating to sustain rotation of said rack; each of said second and third spray jet means comprising a first conduit extending beneath said rack, a second generally vertically extending conduit and a third conduit interconnected with said second conduit and extending above said rack, said second and third conduits being angularly adjustable relative to said rack;

(3) generally cylindrically shaped valve housing carried by said base externally of said closure housing, said valve housing having:

(i) a water inlet adapted to be connected with said source of cold water;

(ii) a first water outlet connected to said spray jet means;

(iii) a second water outlet connected to said collimated jet means; and (iv) an internal valve seat disposed between said water inlet and said second water outlet;

(4) control means for controllably and simultaneously regulating the flow of cold water between said first collimated jet means and said second spray jet means whereby a stream of water can be directed at said rack with sufficient velocity to initiate rotation thereof, said control means comprising a valve assemblage carried within said valve housing, said valve assemblage comprising:

(i) a valve stem having upper and lower extremities, said valve stem being movable from a first position to a second position and including a tapered surface located intermediate its extremities, said tapered surface being adapted to sealably engage said internal valve seat when said valve stem is in a first position; and (ii) biasing means for yieldably urging against movement of said valve stem from a first to a second position.

7. A dishwasher as defined in claim 6 in which said control means further comprises override means carried by said valve housing for overriding said biasing means to prevent movement of said valve stem to said first position whereby a continuous stream of cold water will be directed by said collimated jet means toward said rack.

8. A dishwasher adapted to be operably interconnected with sources of hot and cold water under pressure, comprising:

(a) a base;

(b) a closure housing carried by said base said closure housing comprising a first fixed portion mounted on said base and a second movable portion carried by said base and rotatable with respect to said first portion;

(c) a rack rotatably mounted within said housing, said rack being adapted to support articles to be washed; and (d) jet means for directing a jet of cold water in the direction of said rack to impart rotational movement thereto, said jet means comprising:

(1) a first collimated jet means for emitting a collimated stream of cold water in the direction of said rack at a first velocity for initiating rotation of said rack and for emitting a continuous collimated stream of cold water in the direction of said rack at a second velocity;

(2) second and third spray jet means for sustaining rotation of said rack; said second means directing cold water in the direction of said rack and said third means directing hot water in the direction of said rack; and (3) a valve housing carried by said base externally of said closure housing, said valve housing having:

(i) a cold water inlet;

(ii) a first water outlet connected to said second spray jet means;

(iii) a second water outlet connected to said collimated jet means; and (iv) an internal valve seat disposed between said water inlet and said second water outlet;

(4) control means for controllably and simultaneously regulating the flow of water between said first collimated jet means and said second spray jet means, said control means comprising a valve assemblage carried within said valve housing, said valve assemblage comprising:

(i) a valve stem movable from a first position to a second position to sealably engage said internal valve seat when said valve stem is in a first position; and (ii) biasing means for yieldably urging against movement of said valve stem from a first to a second position;

said control means further including means operably associated with said valve stem for preventing said valve stem from moving to a first position whereby cold water will continuously flow past said internal valve seat.

* * * * *